US009130292B1

(12) United States Patent
Xie et al.

(10) Patent No.: US 9,130,292 B1
(45) Date of Patent: Sep. 8, 2015

(54) CARD CONNECTOR

(71) Applicant: Cheng Uei Precision Industry Co., Ltd., New Taipei (TW)

(72) Inventors: Bao-Geng Xie, Dong-Guan (CN); Wei-Hong Liao, Dong-Guan (CN); Yin-Lung Wu, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/297,612

(22) Filed: Jun. 5, 2014

(51) Int. Cl.

| | |
|---|---|
| ***H01R 24/00*** | (2011.01) |
| ***H01R 4/48*** | (2006.01) |
| ***H01R 13/405*** | (2006.01) |
| ***H01R 12/57*** | (2011.01) |

(52) U.S. Cl.
CPC ..... *H01R 13/405* (2013.01); *H01R 12/57* (2013.01)

(58) Field of Classification Search
CPC .... H01R 13/2442; H01R 12/52; H01R 13/24; H01R 13/2457; H01R 9/091; H01R 13/64; H01R 12/83; H01R 13/641
See application file for complete search history.

(56) References Cited

U.S. PATENT DOCUMENTS

| | | | | |
|---|---|---|---|---|
| 7,371,079 | B2 * | 5/2008 | Yang et al. | 439/74 |
| 7,481,686 | B2 * | 1/2009 | Uchida et al. | 439/862 |
| 8,079,876 | B2 * | 12/2011 | Wang et al. | 439/630 |
| 8,821,191 | B2 * | 9/2014 | Soo | 439/630 |
| 8,864,524 | B2 * | 10/2014 | Sato | 439/630 |

* cited by examiner

*Primary Examiner* — Xuong Chung Trans
(74) *Attorney, Agent, or Firm* — Cheng-Ju Chiang

(57) ABSTRACT

A card connector includes an insulating body and electrical terminals of which each has a fastening portion molded in the insulating body, an elastic arm extending outward and rearward from an external end of the fastening portion and inclined upward during extending, and a soldering portion formed from the other end of the fastening portion. The distal end of the elastic arm further extends and then is bent downward to from a protecting arm. A notching is opened in the elastic arm and extends to the protecting arm. An inner edge of the notching slantwise extends upward and towards the protecting arm and then is arched upward to form a contact arm of which the arch peak rises above the bend peak of the protecting arm. The distal edge of the contact arm protrudes towards two sides to form a pair of blocking ears blocked under the protecting arm.

6 Claims, 4 Drawing Sheets

CARD CONNECTOR

BACKGROUND OF THE INVENTION

1. Field of the Invention

The present invention relates to a connector, and more particularly to a card connector.

2. The Related Art

Along with the development of modern information technology, card connectors are used more and more frequently in electronic products for connecting electronic cards with the electronic products. A known card connector includes an insulating body and a plurality of electrical terminals molded in the insulating body. Each of the electrical terminals has a fastening portion fastened in the insulating body, a contact portion extending outward and rearward from an external end of the fastening portion and inclined upward in the process of extending with a distal end thereof being bent downward, and a soldering portion formed from the other end of the fastening portion and projecting outside the insulating body for being soldered with the electronic product. When the electronic card is inserted backwards into the card connector, a front end of the electronic card touches the distal ends of the contact portions of the electrical terminals and presses the contact portions downward to realize the inverse insertion process of the electronic card in the card connector.

However, on account of the increasing miniaturization on the electronic product, the insulating body of the card connector has a thinner and thinner thickness that causes the distal ends of the contact portions of the electrical terminals to hang above a top surface of the insulating body. In the inverse insertion process of the electronic card, the front end of the electronic card is apt to be inserted under the contact portions of the electrical terminals to deform the electrical terminals. Moreover, even if the contact portions of the electrical terminals are correctly pressed under the electronic card, the distal ends of the contact portions are easy to resist downward against the electronic product and be deformed under the downward press of the electronic card. Finally, the card connector is damaged and loses effectiveness. Therefore, a card connector capable of overcoming the above-mentioned problems is required.

SUMMARY OF THE INVENTION

Accordingly, an object of the present invention is to provide a card connector which includes an insulating body and a plurality of electrical terminals. Each of the electrical terminals has a fastening portion molded in the insulating body, an elastic arm extending outward and rearward from an external end of the fastening portion and inclined upward in the process of extending, and a soldering portion formed from the other end of the fastening portion and projecting outside the insulating body. The distal end of the elastic arm further extends and then is bent downward to from a protecting arm.

A notching is opened in the middle of the elastic arm and extends to the protecting arm. An inner edge of the notching near to the fastening portion slantwise extends upward and towards the protecting arm and then is arched upward at the free end to form a contact arm of which the arch peak rises above the bend peak of the protecting arm. The distal edge of the contact arm protrudes towards two sides to form a pair of blocking ears blocked under the protecting arm. The arch peak of the contact arm and the bend peak of the protecting arm project upward beyond a top face of the insulating body.

As described above, the card connector of this present invention utilizes the cooperation of the protecting arms and the blocking ears of the electrical terminals to firstly presses the protecting arms and then press the contact arms downward so as to smoothly realize the inverse insertion process of the electronic card in the card connector. The structure design of the protecting arm and the contact arm of the electrical terminal can effectively avoid the distal edges of the contact arm and the protecting arm resisting downward against an inside of an electronic product and further avoid the contact arm and the protecting arm deforming.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
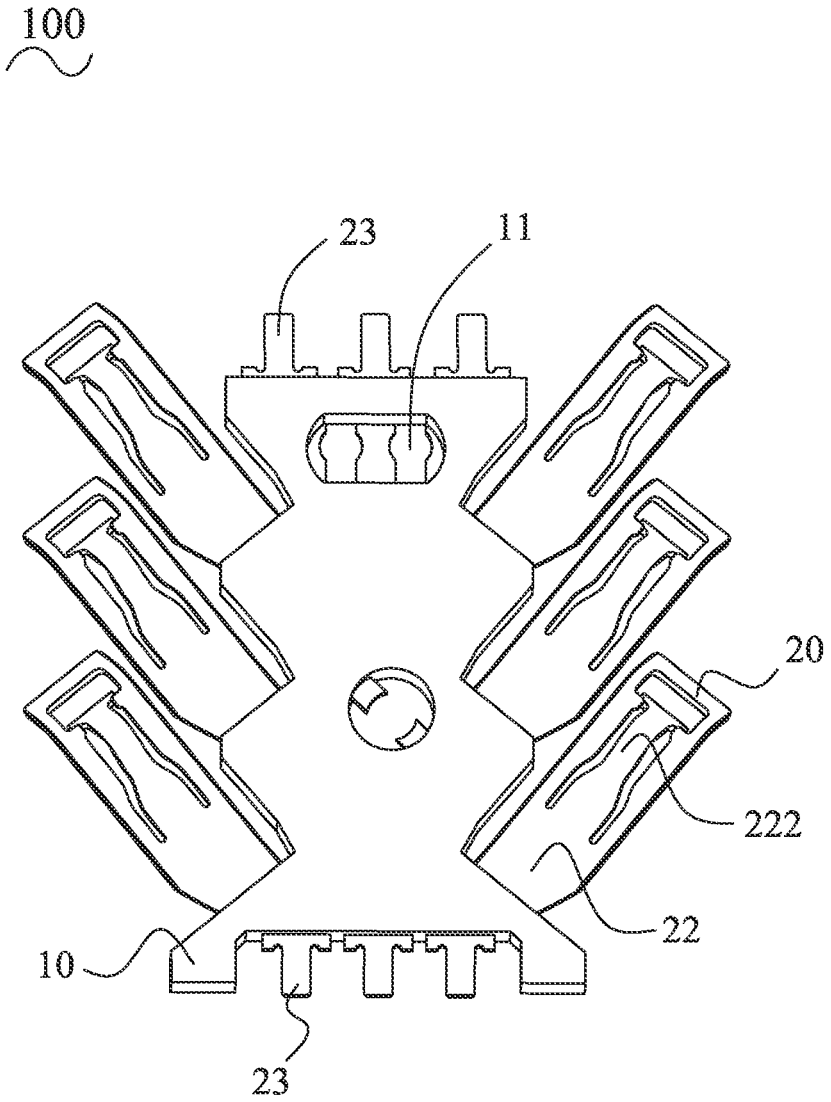
FIG. 1 is a perspective view of a card connector according to an embodiment of the present invention.
Figure 2:
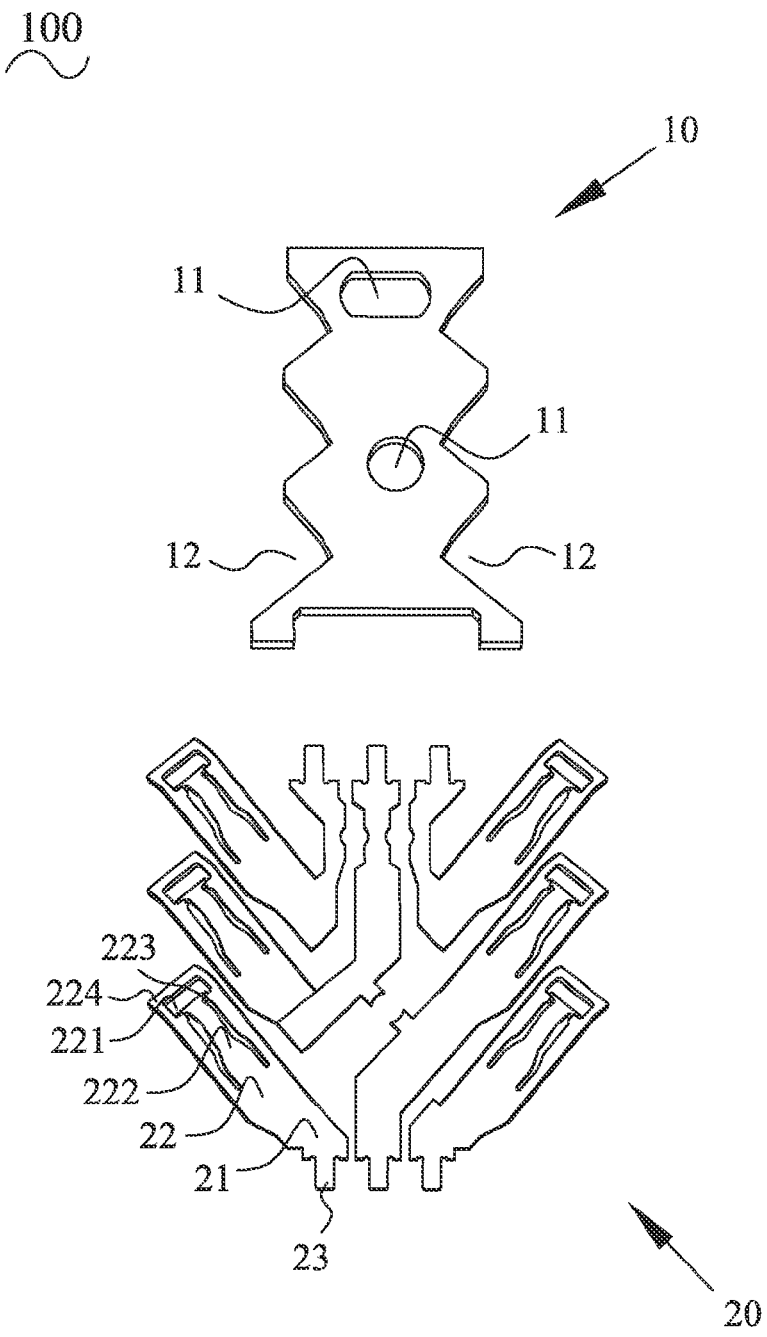
FIG. 2 is an exploded view of the card connector of FIG. 1.
Figure 3:
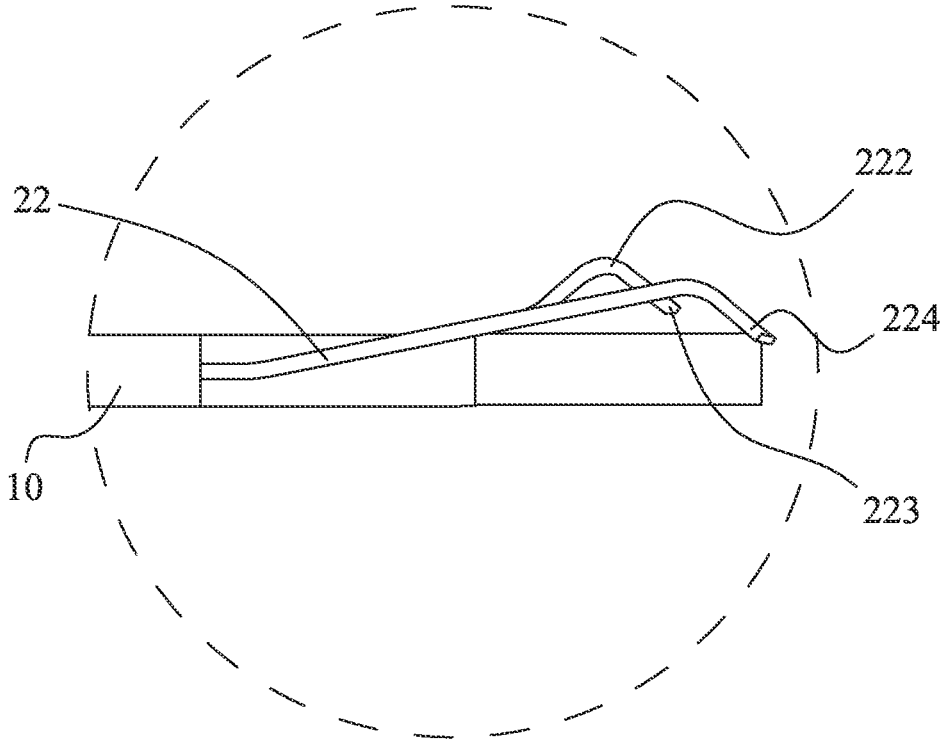
FIG. 3 is an enlarged view of a rear of an electrical terminal in an insulating body of the card connector shown in FIG. 1.

With reference to FIG. 1, FIG. 2 and FIG. 3, a card connector 100 in accordance with an embodiment of the present invention is adapted for receiving an electronic card (not shown) therein. The card connector 100 includes an insulating body 10 and a plurality of electrical terminals 20.

The insulating body 10 is of rectangular board shape. A middle and a rear of the insulating body 10 are opened with a die-cutting window 11 respectively. Two opposite side faces of the insulating body 10 are concaved inward to form a plurality of terminal grooves 12 arranged at regular interval from front to rear. Each of the terminal grooves 12 penetrates vertically through the insulating body 10 and extends slantwise forward.

The electrical terminals 20 are arranged into two longitudinal rows. Each of the electrical terminals 20 has a fastening portion 21 molded in the insulating body 10, an elastic arm 22 extending outward and rearward from an external end of the fastening portion 21 and inclined upward in the process of extending, and a soldering portion 23 formed from the other end of the fastening portion 21 and projecting outside the insulating body 10. The distal end of the elastic arm 22 further extends and then is bent downward to from a protecting arm 224.

A notching 221 is opened in the middle of the elastic arm 22 and extends to the protecting arm 224. An inner edge of the notching 221 near to the fastening portion 21 slantwise extends upward and towards the protecting arm 224 and then is arched upward at the free end to form a contact arm 222 of which the arch peak rises above the bend peak of the protecting arm 224. The distal edge of the contact arm 222 protrudes towards two sides to form a pair of blocking ears 223 blocked under the protecting arm 224.

Preferably, the contact arm 222 of the electrical terminal 20 has the front part thereof abreast with the elastic arm 22 and the arched part thereof located in front of the bend peak of the protecting arm 224.

The elastic arms 22 of the electrical terminals 20 project outward and rearward in the terminal grooves 12 of the insulating body 10 respectively. The arch peaks of the contact arms 222 and the bend peaks of the protecting arms 224 project upward beyond a top face of the insulating body 10. The soldering portions 23 of the electrical terminals 20 project in front of and behind the insulating body 10.

Figure 4:
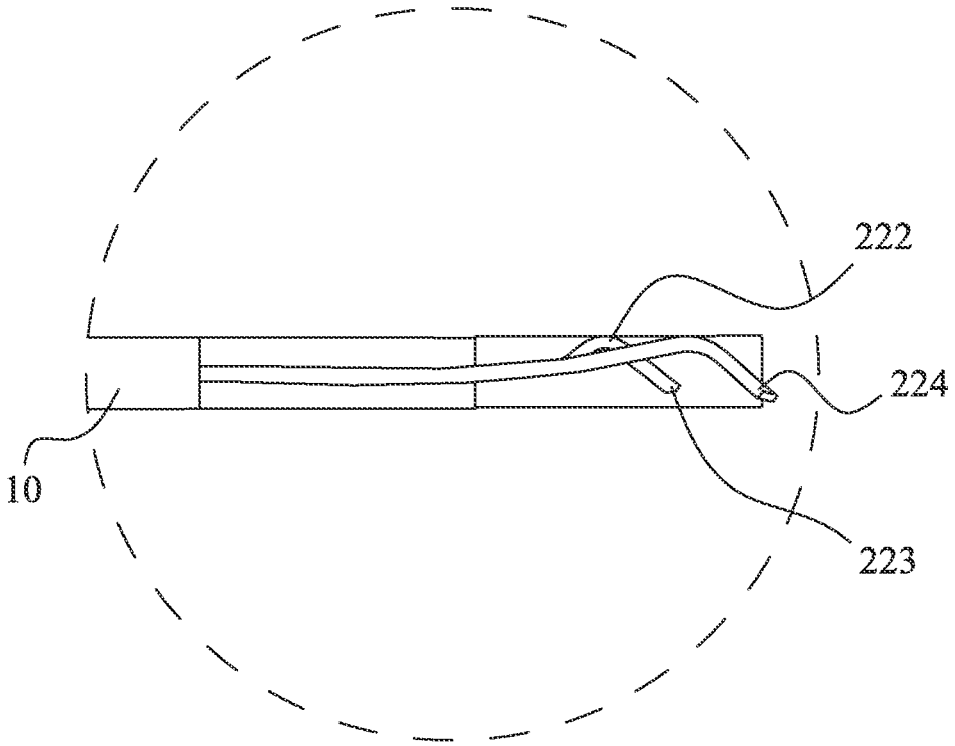
FIG. 4 is an enlarged view showing the electrical terminal of FIG. 3 is pressed downward.

Referring to FIG. 3 and FIG. 4, in this embodiment, the distal edge of the protecting arm 224 of the electrical terminal 20 is located to be lower than the top face of the insulating body 10, and the distal edge of the contact arm 222 of the electrical terminal 20 is located to be higher than the top face of the insulating body 10. In use, when the electronic card is inserted into the card connector 100 from front to rear, the contact arms 222 of the electrical terminals 20 are directly pressed downward by the electronic card so as to realize the direct insertion process of the electronic card in the card connector 100. When the electronic card is inserted into the card connector 100 from rear to front, the electronic card firstly touches and presses the protecting arms 224 of the electrical terminals 20 downward, then the protecting arms 224 drive the contact arms 222 to move downward by virtue of the blocking ears 223 so as to smoothly realize the inverse insertion process of the electronic card in the card connector 100 and effectively avoid the protecting arms 224 of the electrical terminals 20 being jacked up by the electronic card to deform.

Referring to FIG. 3 and FIG. 4 again, in this embodiment, the altitude between the bend peak and the distal edge of the protecting arm 224 is greater than that between the arch peak and the distal edge of the contact arm 222. Therefore, in the inverse insertion process of the electronic card in the card connector 100, the electronic card moves forward to firstly press the protecting arms 224 of the electrical terminals 20 and then press the contact arms 222 by virtue of the cooperation of the protecting arms 224 and the blocking ears 223, so that can effectively avoid the distal edges of the contact arms 222 and the protecting arms 224 resisting downward against an inside of an electronic product (not shown) and further avoid the contact arms 222 and the protecting arms 224 deforming.

As described above, the card connector 100 of this present invention utilizes the cooperation of the protecting arms 224 and the blocking ears 223 of the electrical terminals 20 to firstly presses the protecting arms 224 and then press the contact arms 222 downward so as to smoothly realize the inverse insertion process of the electronic card in the card connector 100. The structure design of the protecting arm 224 and the contact arm 222 of the electrical terminal 20 can effectively avoid the distal edges of the contact arm 222 and the protecting arm 224 resisting downward against an inside of the electronic product and further avoid the contact arm 222 and the protecting arm 224 deforming.

What is claimed is:

1. A card connector, comprising:

an insulating body; and a plurality of electrical terminals of which each has a fastening portion molded in the insulating body, an elastic arm extending outward and rearward from an external end of the fastening portion and inclined upward in the process of extending, and a soldering portion formed from the other end of the fastening portion and projecting outside the insulating body;

wherein the distal end of the elastic arm further extends and then is bent downward to form a protecting arm, a notching is opened in the middle of the elastic arm and extends to the protecting arm, an inner edge of the notching near to the fastening portion slantwise extends upward and towards the protecting arm and then is arched upward at the free end to form a contact arm of which the arch peak rises above the bend peak of the protecting arm, the distal edge of the contact arm protrudes towards two sides to form a pair of blocking ears blocked under the protecting arm, the arch peak of the contact arm and the bend peak of the protecting arm project upward beyond a top face of the insulating body.

2. The card connector as claimed in claim 1, wherein the altitude between the bend peak and the distal edge of the protecting arm is greater than that between the arch peak and the distal edge of the contact arm.

3. The card connector as claimed in claim 1, wherein the distal edge of the protecting arm of the electrical terminal is located to be lower than the top face of the insulating body, and the distal edge of the contact arm of the electrical terminal is located to be higher than the top face of the insulating body.

4. The card connector as claimed in claim 1, wherein the contact arm of the electrical terminal has the front part thereof abreast with the elastic arm and the arched part thereof located in front of the bend peak of the protecting arm.

5. The card connector as claimed in claim 1, wherein two opposite side faces of the insulating body are concaved inward to form a plurality of terminal grooves arranged at regular interval from front to rear, each of the terminal grooves penetrates vertically through the insulating body and extends slantwise forward, the elastic arms of the electrical terminals project outward and rearward in the terminal grooves respectively, and the soldering portions of the electrical terminals project in front of and behind the insulating body.

6. The card connector as claimed in claim 1, wherein a middle and a rear of the insulating body are opened with a die-cutting window respectively.

* * * * *